United States Patent [19]

Bissinger

[11] 4,112,634

[45] Sep. 12, 1978

[54] STORAGE BIN

[76] Inventor: Wilma Bissinger, Muhlstrasse 30, D-7129 Pfaffenhofen, Germany

[21] Appl. No.: 772,251

[22] Filed: Feb. 25, 1977

[30] Foreign Application Priority Data

May 12, 1976 [DE] Fed. Rep. of Germany ..... 2621009

[51] Int. Cl.[2] ..... E04B 1/346

[52] U.S. Cl. ..... 52/67; 52/194; 52/197

[58] Field of Search ..... 52/192, 194, 195, 197, 52/67, 64, 245, 126, 66, 632, 247; 220/8

[56] References Cited

U.S. PATENT DOCUMENTS

| | | | |
|---|---|---|---|
| 2,635,302 | 4/1953 | Denning | 52/67 X |
| 2,827,004 | 8/1958 | Luce et al. | 220/8 X |
| 2,887,243 | 5/1959 | Murdock, Sr. | 220/8 |
| 2,944,852 | 7/1960 | Snyder | 52/67 |
| 3,248,024 | 4/1966 | Keathyly | 52/197 X |
| 3,463,541 | 8/1969 | Garrison | 52/66 X |
| 3,694,024 | 9/1972 | Linville | 52/66 X |

FOREIGN PATENT DOCUMENTS

| | | | |
|---|---|---|---|
| 2,308,762 | 4/1975 | France | 52/67 |
| 415,938 | 5/1946 | Italy | 52/67 |

*Primary Examiner*—Price C. Faw, Jr.
*Assistant Examiner*—Carl D. Friedman

[57] ABSTRACT

A storage bin such as a silo or the like having a plurality of sections adapted to be superimposed one on the other. The respective sections increasing stepwise in external dimension, in axial succession from bottom to top of said bin, and being telescopingly nested together between a collapsed and an extended position.

17 Claims, 5 Drawing Figures

STORAGE BIN

BACKGROUND OF THE INVENTION

The invention relates to storage bins and in particular to silos for frangible material, such as grains, silage, sand and the like, which silos can be assembled vertically from several components.

The assembly of a storage bin such as a silo, formed of several components has proved successful especially in larger sizes, because separable stackable components require only a fraction of the space during transportation to the installation site as well as in storage. The components may be designed so that when collapsed they form a cohesive and easily transportable unit which can be moved by truck without taking any special measures.

In the known multipart storage bins the assembly is made in three parts; a middle or central section, of largest external diameter to which a bottom section having a discharge funnel and a top section having a cover are fastened. The connection between the parts is being made through external flanges which are fitted together by several screw or bolt fasteners. The top section is generally of smaller external diameter than the mid section but larger than the bottom section.

During transport and storage, the top section is first inserted in the middle section by turning it 180° and then the bottom section is inserted within the top section likewise by turning it 180°. In assembling the storage bin, the bottom section must be taken out, rotated, and then connected with the underside of the middle section. Thereafter the top section is taken out, rotated, and connected with the top side of the middle section. From this alone it can be seen that establishing the transport position and the working position of the collapsible storage bin requires considerable cost in labor.

It is an object of the present invention to provide a storage bin of the above-mentioned kind so that it can be converted from the working position to the transport position and vice versa with much less cost and without losing the advantages of the known collapsible storage bin — that is in saving space both in storage and during transport, as well as simple manufacture of the components.

The foregoing objects, other objects as well as numerous advantages will be seen from the following disclosure of the present invention.

SUMMARY OF THE INVENTION

According to the invention, a storage bin is provided, formed of a plurality of sections, each section having internal and external dimensions which increase in axial succession over the height of the storage bin diametrically stepwise from the bottom to the top sections, so that they nest one in the other in telescope fashion. That is, each of the successively arranged sections are adapted to be superimposed one on top of the other and are successively dimensioned so that they are each larger than the preceding section moving from bottom to top.

By this stepped gradation of the sections it is possible, without any rotation or turning over, and by simply pulling them apart and pushing them together, to set up the bin in working or the transport position. As a result, this construction greatly reduces the cost of erection and the effort in setting up the bin at the place of use. Moreover, the construction opens up new possibilities of connecting the components with one another, in multi section arrangements.

According to one embodiment, each section is formed having a radially outwardly directed flange extending from the perimeter of its upper edge and a radially inwardly directed flange extending from the perimeter of its lower edge. The inward flange spans the depth of the outward flange so that its upper surface engages the lower surface of the outward flange. The flanges may be formed by bending the edges of the respective sections inwardly or outwardly to the ledges; they are preferably formed by attaching L-shaped angle brackets and molding strips to the respective edges of the sections. This design has the advantage that when the components are pulled apart in erection they cannot become detached from each other and are necessarily brought into the working position without any turning or other alignment steps. The engaging flanges may be connected together by suitable bolts, screws, etc., in the extracted position. This can be achieved with less cost, since in the telescoped as well as in the extended position, the components can be fixed immovably relatively to each other by suitable guide means.

In order that the outward flanges will not impair the sliding of one component into the other when setting up the transport position, it is provided that the horizontal leg of the outwardly extending flange is always smaller in its external diameter than the inside diameter of the adjacent upper section in which it nests.

A tight seal of the components between the engaging surfaces may be obtained by providing a packing or sealant between the faces of the inward and outward flanges of adjacent sections.

The erection of the storage bin at the place of use is further simplified and facilitated by the present invention by providing pivotable latch means for fixing the extended position of adjacent sections. The latches are provided on the exterior of the respective lower component in the region of the open top edge, and include a lever which braces over an arcuate stop on the underside of the inner flange of the cooperative upper section and gripping the outward flange of the lower section against the inward flange of the upper component. Specifically the design is such that the pivotable latches are held by means of screws on the component, the screws being able to be fastened into nuts which are secured on the angle bracket or molding forming the flange and can be screwed through bores in the levers, component, and angle bracket etc. Each lever is additionally fixable in the tensioning position by means of another screws.

For storage or transport fixation in the collapsed position may be obtained by means of connecting links or the like on the innerward flanges and/or the outerward flanges to form a connected unit.

The function of the collapsible storage bin may be completed by providing the bottommost component with a conical discharge funnel over at least a portion of its height, and by providing the topmost component with a cover.

From the static standpoint, it is preferred that all components have round cross-section and a cylindrical form, although square or rectangular forms can also be used. The components can be easily cut from sheet metal, which is easy to shape and weld together.

According to another embodiment, the bottom section may be completely made as a conical discharge funnel resting on, or connected to the innerward flange of the next higher section. In this way a simple attachment for the supporting legs carrying the storage bin may be obtained, by removably connecting them to the inner flange of the section on which the funnel rests. In this case the storage bin can be placed in the transport position with the supporting legs attached, which may be of advantage for special uses of the storage bin.

Full details of the present invention are set forth in the following description and illustrated in the accompanying drawings.

DESCRIPTION OF THE INVENTION

Figure 1:
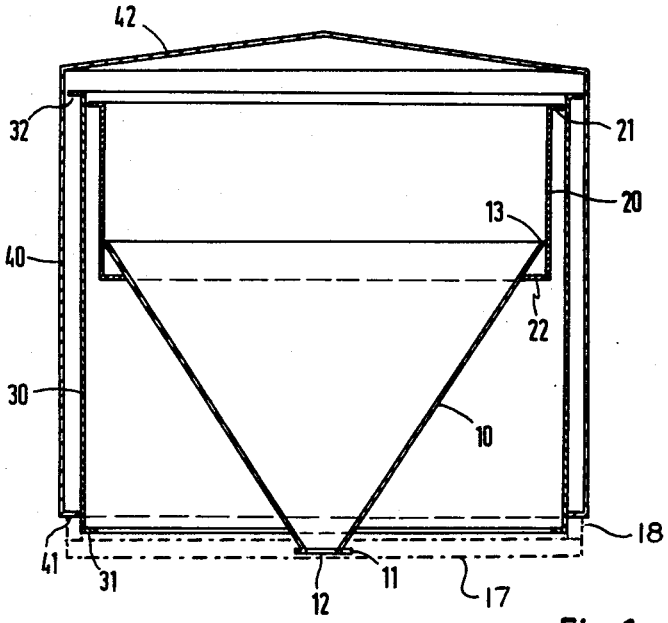
FIG. 1 illustrates a three-part storage bin according to the invention in the telescoped transport position.
Figure 2:
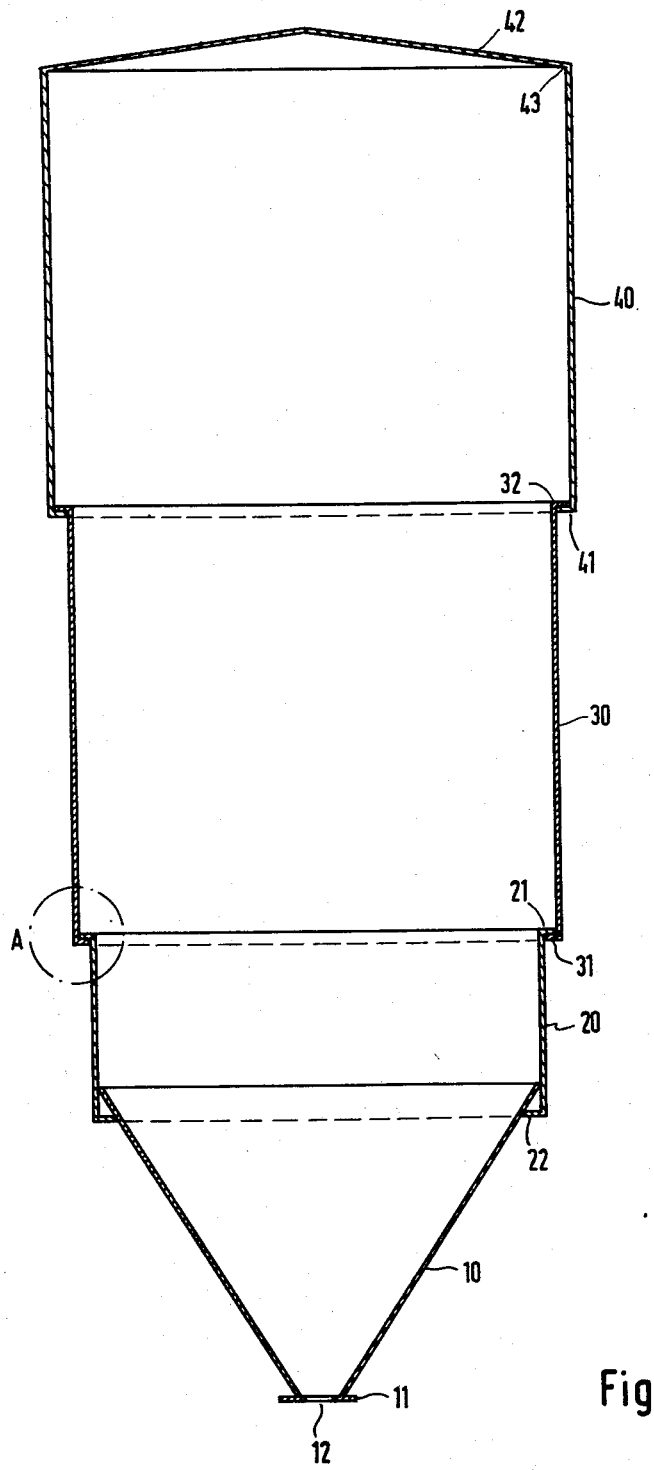
FIG. 2 illustrates the storage bin according to FIG. 1 in the extended working position.

The storage bin according to FIGS. 1 and 2 is designed as a large silo composed of three sections 20, 30 and 40 of large tubular wall construction open at the top and bottom, each of successively increasing internal and external diameter. The bottom section 20 is provided with a discharge funnel 10 having a radially extending flange 1 surrounding a discharge opening 12. Outlet valves or other discharge devices can be connected to the flange 11 permitting selective withdrawl of the material in the silo. The bin can be used to house silage, grains, granular material, sand, rocks and the like. The bottom section 20 and the discharge funnel 10 occupies the same partial height as either the sections 30 and 40. Section 20 supports funnel 10 by means of an inwardly directed radial flange 22, to which it is welded, as indicated by a weld 13 between the interior surface of component funnel. The lower section 20 may be provided with an inwardly directed flange 22 which may also be welded to funnel 10.

The upper open edge of the section 20 terminates in an outwardly directed flange 21, which spans (i.e., of a depth) an inwardly directed flange 31 formed on the lower edge of the adjacent central section 30. The flange 21 takes support on the top side of flange 31 when the storage bin is brought into the working position as seen in FIG. 2. The central section 30 terminates at its open upper edge in an outwardly directed flange 32 which spans an inwardly directed flange 41 formed at the perimeter of the bottom edge of the upper section 40 and takes support on the top side thereof of flange 32 when the storage bin is brought into the working position. The upper section 40 is closed by the cover 42, which may be hinged or welded to section 40, as weld 43 indicates.

Section 20 with the funnel 10, as well as the central component 30 can each be completely prefabricated prior to assembly. The central section 30 is first slipped over the lower section 20 from below or the lower section inserted downwardly into the central section. Thereafter, the section 40 is slipped over the nested sections 20 and 30 from below without its cover 42. Finally, the top section is closed by means of the cover 42. The thus nested sections 20, 30 and 40 have stepped external diametral or diagonal dimensions which extend over the height of the storage bin, increasing stepwise from the lower section 20 to the upper section 40, so that these components can be telescopingly collapsed and extended. As can be seen from FIG. 2, the sections 20, 30 and 40 cannot become detached from each other once assembled, unless the cover 42 is first removed or the flanges broken. The inward and outward flanges in the region of their connection planes immediately determine the extended or working position of the sections 20, 30 and 40 relative to each other. The height size may be adjusted by not extending one or more of the sections.

It is easy to see that alternatively several central sections 30 may be additionally provided. These central sections will, of course, be enlarged stepwise in their external dimensions, so that the telescope type nesting is preserved. At the open lower edge, each of these central sections will be provided with a corresponding inwardly directed flange and at the open top edge with a corresponding outwardly directed flange, as is each of the sections shown in the drawings.

As can be seen from FIG. 1, sections 20, 30 and 40 are designed with the same partial height (i.e., each is equal to the other). When the sections are fully collapsed one into the other, the inward flanges 31 and 41 lie in substantially a common plane with the fastening flange 11 of the discharge funnel 10, so that these flanges can easily be interconnected through a connecting or fastening link such as bar 17, or secured by screws 18, hooks or the like to the outermost of the superimposed section and extending over the lower edges of the inner sections. The same situation applies to the outwardly directed flanges 21 and 32, which can be interconnected in the same manner. In this way, the sections 20, 30 and 40 can be secured for transport in a united, rigid, inseparable assembly.

Figure 4:
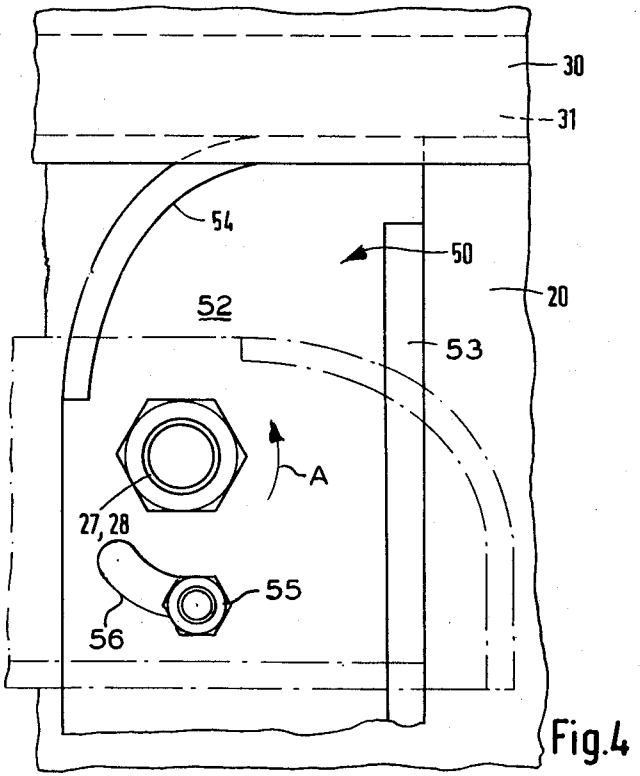
FIG. 4 is a side view of the joint according to FIG. 3.
Figure 3:
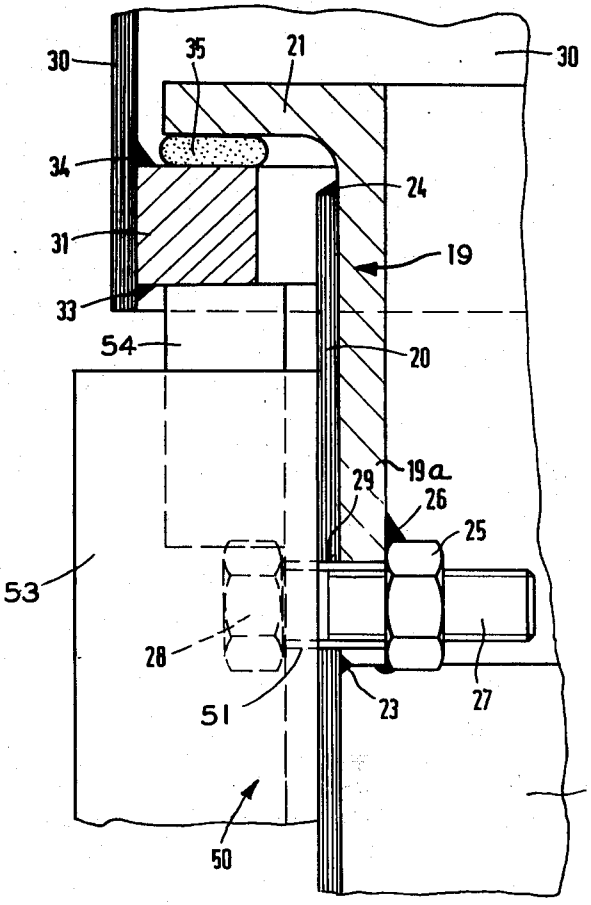
FIG. 3 is an enlarged view of the detail section of the area A marked in FIG. 2, with the rotatably mounted pivot lever for the bracing of the components in the region of the connection plane between the flanges.

In the enlarged detail of Area A, seen in FIGS. 3 and 4, the means for formation of the flanges and their connection is detailed. The inwardly directed flange 31 is formed by a solid molding strip, which is welded adjacent the inner perimeter of the opening under edge through the weld seams 33 and 34. The inwardly directed flanges (e.g., 41) of the other sections (e.g., 40) may also be formed in this manner. The molding strip may extend annularly or about the entire perimeter or only a portion thereof.

On the other hand, the outwardly directed flange 21 is formed by welding an angle bracket 19 of an L-shaped cross-section to the upper edge of the component. The bracket 19 has its vertical leg 19*a* preferably on the inner surface of the respective section (illustrated as the lower section 20) and is secured by welds 23 and 24 fixed to the section wall. The horizontal leg 21 of this angular bracket extends outwardly from the perimeter of the section and has an external dimension or extent from the surface of the superimposed surrounding section (e.g., 30) which is always smaller than the internal dimension of the surrounding section within which it is nested, except of course for the inner flange 31 thereof. The horizontal leg 21 of the angular bracket 19 therefore extends over the upper surface of the inward flange 31 and can rest thereon. A packing or suitable sealant element 35 may be arranged between the inner flange 31 and the outer flange 21 and may, if desired be secured to or adhered to one of these flanges by a suitable adhesive, for example.

The angular bracket may be annular, i.e., extending about the entire perimeter of the section; however, it need not be so and may easily be made merely in arcuate sections, one or more of which being spaced about the perimeter. It will be obvious that each of the tubular sections are made similarly.

The latch means for disengagably connecting the adjacent sections is also shown in FIGS. 3 and 4. A nut 25 is secured by a weld 26 to the interior surface of the bracket 19 and is adapted to threadedly receive the thread end 27 of a screw 28 passing through a bore 29 made in the wall of the tubular section 20 and the bracket 19. The screw 28 holds a latch lever 50, first passing through a bore 51. The latch lever 50 is freely swingable and removable by withdrawal of the screws. It is formed of a plate-like member 52, which is stiffened along a longitudinal edge by the web 53 extending perpendicularly from its surface. The latch lever 50 also has an arcuate contact web 54 extending perpendicularly from the plate member which is adapted to engage on the underside of the inner flange of the next higher or surrounding tubular section (e.g., 31). The lever 50 and the arcuate web 54 are of such size that the lever 50 is rotated in the direction of arrow A (FIG. 4), the molding 31 is progressively compressed between the web 54 and the outer flange 21 which is then pulled against the inner flange 31 so as to fixedly braced. The packing elemment 35, if used, is also compressed so as to provide a firm sealing joint. The latch lever 50 can be fixed in its tensioning position by means of another, but removble screw or spring loaded locking pin illustrated by numeral 55. This screw can be guided through an arcuate slot 56 in the pivot lever 50 and be screwed into a threaded bore of section 20.

Several pivot levers are provided over the perimeter of the tubular sections so that a secure uniform connection between adjacent sections is established. Sections 20, 30 and 40, as well as any additional sections may thus be fixed in the working position relatively to each other and are interconnected in the connection planes and without any possibility of dislodgement. The latch lever 50 is removed from each section prior to collapse of the bin, by removal of the screw 28. The latch is replaced only when the bin is placed in extended position.

Figure 5:
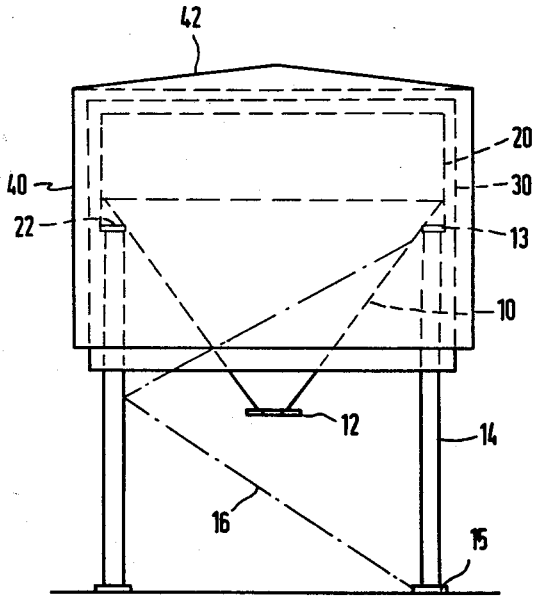
FIG. 5 illustrates a storage bin with retracted support legs in the transport position.

As seen in FIG. 5, the inward flange 22 of the lowermost section 20 is provided with attachment plates 13 for connection thereto of support legs 14. The attachment plates are provided so that they do not extend outwardly of the external dimension of section 20 and the support legs 14 can, therefore, remain connected with section 20 when the storage bin is brought into its collapsed condition for transport. These supports 14 can be stiffened in known manner by cross braces 16 and may be provided with footings 15.

Various modifications and changes have been suggested in the foregoing description. Others will be obvious to those skilled in this art. Consequently, it is intended that the present disclosure be illustrative only and not limiting of the scope of the invention.

What is claimed:

1. A storage bin such as a silo or the like comprising a plurality of sections adapted to be superimposed one on the other, said sections increasing stepwise in external dimension, in axial succession from bottom to top of said bin, and being telescopingly nested together between a collapsed and an extended position, said sections being provided with an outwardly directed flange adjacent their upper edge and an inwardly directed flange adjacent their lower edge, said flanges having overlapping surfaces whereby the outwardly directed flange of a lower section engages over the inwardly directed flange of the next contiguous upper section, and means for removably securing said sections together comprising at least one pivotable latch removably mounted on the outer surface of the respective lower component spaced below the outwardly extending flange, said latch being adapted to be pivoted into engagement with the inwardly directed flange of the next adjacent section to apply a clamping force thereagainst said inwardly directed flange against the adjacent outwardly directed flange.

2. The storage bin according to claim 1, wherein said flanges extend about the entire perimeter of the respective sections.

3. The storage bin according to claim 1, wherein said inwardly directed flange is formed of a continuous molding strip secured to the inner surface of its respective section.

4. The storage bin according to claim 3, wherein the outwardly directed flange is formed by an L-shaped angle bracket having its vertical leg secured to the surface of its respective section.

5. The storage bin according to claim 1, wherein the outwardly directed flange has an extent less than the inner dimension of the next upper section.

6. The storage bin according to claim 1, including seal means arranged between the engaging flanges.

7. The storage bin according to claim 1, including means for linking said sections together in collapsed position.

8. The storage bin according to claim 1, including a cover for the upper edge of the topmost section.

9. The storage bin according to claim 1, wherein said sections are cylindrical.

10. The storage bin according to claim 1, including supporting legs, and means for attaching said supporting legs to the inwardly directed flange of the bottommost section.

11. The storage bin according to claim 1 wherein said latch means comprise a plate like body portion and an arcuate lever portion extending perpendicularly therefrom, said body portion being adapted to be removably secured to said outer surface of the lower component so that on pivoting thereof said arcuate portion engages the inward flange of the upper component.

12. The storage bin according to claim 11, wherein said latch is secured to the respective section by screw means adapted to removably seat within a bolt fixedly secured to the inner surface of said section, in axial alignment with a bore formed in the wall of said section.

13. The storage bin according to claim 12 including second bolt means passing through said plate to secure said latch against rotation in bracing condition.

14. The storage bin according to claim 1, including a discharge funnel member secured within the bottom most section and extending outwardly therefrom.

15. The storage bin according to claim 1, wherein the axial length of said bottommost section and said funnel is substantially equal to that of the next adjacent section in which it is nested.

16. A storage bin such as a silo or the like comprising a plurality of sections adapted to be superimposed one on the other, said sections increasing stepwise in external dimension, in axial succession from bottom to top of said bin, and being telescopingly nested together between a collapsed and an extended position, said sections being provided with an outwardly directed flange adjacent their upper edge and an inwardly directed flange adjacent their lower edge, said flanges having overlapping surfaces whereby the outwardly directed flange of a lower section engages over the inwardly directed flange of the next contiguous upper section, and means for removably securing said sections together comprising at least one pivotable latch mounted on the outer surface of the respective lower component spaced from the outwardly extending flange, said latch being adapted to engage the inwardly directed flange of the next adjacent section to brace said flanges together, said latch being secured to the respective section by screw means adapted to removably seat within a bolt fixedly secured to the inner surface of said section, in axial alignment with a bore formed in the wall of said section.

17. The storage bin according to claim 16, including means for securing said latch against rotation when in bracing position.

* * * * *